US006022163A

United States Patent [19]

Asfur

[11] Patent Number: 6,022,163

[45] Date of Patent: Feb. 8, 2000

[54] GEL DISPENSING HAIR BRUSH

[76] Inventor: Amal Asfur, 7345 W. Addison, Chicago, Ill. 60634

[21] Appl. No.: 09/191,550

[22] Filed: Nov. 13, 1998

[51] Int. Cl.[7] ..... A45D 24/22

[52] U.S. Cl. ..... 401/175; 401/268; 222/390; 132/112

[58] Field of Search ..... 401/28, 175, 268; 222/390; 132/112

[56] References Cited

U.S. PATENT DOCUMENTS

| | | | |
|---|---|---|---|
| 1,783,754 | 12/1930 | Stepelton | 401/175 |
| 2,456,687 | 12/1948 | Dominguez | 401/28 X |
| 2,774,981 | 12/1956 | Bonilla | 401/175 |
| 3,728,035 | 4/1973 | Reitknecht | 401/175 |
| 5,289,835 | 3/1994 | Harlan et al. | 222/390 X |
| 5,634,531 | 6/1997 | Graf et al. | 222/390 X |

FOREIGN PATENT DOCUMENTS

| | | | |
|---|---|---|---|
| 973667 | 9/1975 | Canada | 401/175 |
| 182307 | 5/1986 | European Pat. Off. | 401/268 |

*Primary Examiner*—Steven A. Bratlie

[57] ABSTRACT

A gel dispensing hair brush for automatically dispensing hair styling gel from a plurality of hollow bristles. The device includes a handle portion having an open end, a closed end defined by an end wall, and an elongated cavity formed therein. A brush portion is attachable to the handle portion open end and has a reservoir in communication with the elongated cavity, the brush portion further comprising a bottom wall, the bottom wall having a plurality of spaced hollow bristle members in communication with the reservoir. An end portion is attachable to the handle portion closed end and includes a direct current motor for rotating a shaft/piston assembly disposed in the elongated cavity and thereby dispensing the gel from the elongated cavity through the hollow bristle members.

7 Claims, 3 Drawing Sheets

GEL DISPENSING HAIR BRUSH

BACKGROUND OF THE INVENTION

1. Field of the Invention

The present invention relates to liquid dispensing brushes and more particularly pertains to a new gel dispensing hair brush for automatically dispensing hair styling gel from a plurality of hollow bristles.

2. Description of the Prior Art

The use of liquid dispensing brushes is known in the prior art. More specifically, liquid dispensing brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art liquid dispensing brushes include U.S. Pat. Nos. 4,938,621; 4,543,913; 4,875,792; 4,277,193 and 3,964,501.

While these devices fulfill their respective, particular objectives and requirements, the aforementioned patents do not disclose a new gel dispensing hair brush. The inventive device includes a handle portion having an open end, a closed end defined by an end wall, and an elongated cavity formed therein, a brush portion attachable to the handle portion open end and having a reservoir in communication with the elongated cavity, the brush portion further comprising a bottom wall, the bottom wall having a plurality of spaced hollow bristle members in communication with the reservoir, an end portion attachable to the handle portion closed end, and a means for dispensing the gel from the elongated cavity through the hollow bristle members.

In these respects, the gel dispensing hair brush according to the present invention substantially departs from the conventional concepts and designs of the prior art, and in so doing provides an apparatus primarily developed for the purpose of automatically dispensing hair styling gel from a plurality of hollow bristles.

SUMMARY OF THE INVENTION

In view of the foregoing disadvantages inherent in the known types of liquid dispensing brushes now present in the prior art, the present invention provides a new gel dispensing hair brush construction wherein the same can be utilized for automatically dispensing hair styling gel from a plurality of hollow bristles.

The general purpose of the present invention, which will be described subsequently in greater detail, is to provide a new gel dispensing hair brush apparatus and method which has many of the advantages of the liquid dispensing brushes mentioned heretofore and many novel features that result in a new gel dispensing hair brush which is not anticipated, rendered obvious, suggested, or even implied by any of the prior art liquid dispensing brushes, either alone or in any combination thereof.

To attain this, the present invention generally comprises a handle portion having an open end, a closed end defined by an end wall, and an elongated cavity formed therein, a brush portion attachable to the handle portion open end and having a reservoir in communication with the elongated cavity, the brush portion further comprising a bottom wall, the bottom wall having a plurality of spaced hollow bristle members in communication with the reservoir, an end portion attachable to the handle portion closed end, and a means for dispensing the gel from the elongated cavity through the hollow bristle members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new gel dispensing hair brush apparatus and method which has many of the advantages of the liquid dispensing brushes mentioned heretofore and many novel features that result in a new gel dispensing hair brush which is not anticipated, rendered obvious, suggested, or even implied by any of the prior art liquid dispensing brushes, either alone or in any combination thereof.

It is another object of the present invention to provide a new gel dispensing hair brush which may be easily and efficiently manufactured and marketed.

It is a further object of the present invention to provide a new gel dispensing hair brush which is of a durable and reliable construction.

An even further object of the present invention is to provide a new gel dispensing hair brush which is susceptible of a low cost of manufacture with regard to both materials and labor, and which accordingly is then susceptible of low prices of sale to the consuming public, thereby making such gel dispensing hair brush economically available to the buying public.

Still yet another object of the present invention is to provide a new gel dispensing hair brush which provides in the apparatuses and methods of the prior art some of the advantages thereof, while simultaneously overcoming some of the disadvantages normally associated therewith.

Still another object of the present invention is to provide a new gel dispensing hair brush for automatically dispensing hair styling gel from a plurality of hollow bristles.

Yet another object of the present invention is to provide a new gel dispensing hair brush which includes a handle portion having an open end, a closed end defined by an end wall, and an elongated cavity formed therein, a brush portion attachable to the handle portion open end and having a reservoir in communication with the elongated cavity, the brush portion further comprising a bottom wall, the bottom wall having a plurality of spaced hollow bristle members in communication with the reservoir, an end portion attachable to the handle portion closed end, and a means for dispensing the gel from the elongated cavity through the hollow bristle members.

Still yet another object of the present invention is to provide a new gel dispensing hair brush that dispenses hair styling gel without creating a mess.

Even still another object of the present invention is to provide a new gel dispensing hair brush that evenly dispenses hair styling gel.

Still yet another object of the present invention is to provide a new gel dispensing hair brush that is easily refillable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
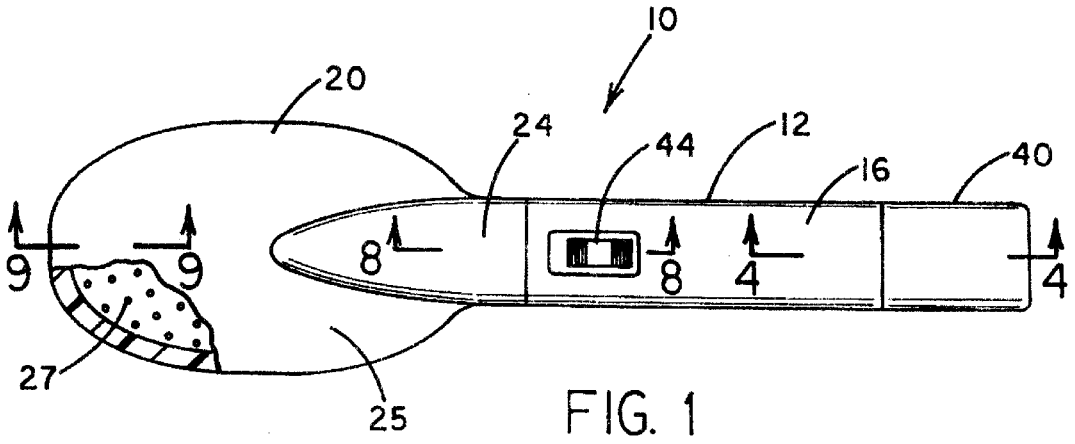
FIG. 1 is a partially sectioned top plan view of a new gel dispensing hair brush according to the present invention.

With reference now to the drawings, and in particular to FIGS. 1 through 9 thereof, a new gel dispensing hair brush embodying the principles and concepts of the present invention and generally designated by the reference numeral 10 will be described.

More specifically, it will be noted that the gel dispensing hair brush 10 comprises a handle portion 12 having an open end 13, a closed end 14 defined by an end wall 15, and an elongated cavity 18 centrally formed therein. A brush portion 20 is attachable to the handle portion open end 13 and has a reservoir 21 in communication with the elongated cavity 18, the brush portion 20 further having a bottom wall 23 which includes a plurality of spaced hollow bristle members 30 in communication with the reservoir 21. An end portion 40 is attachable to the handle portion closed end 14 and a means for dispensing the gel from the elongated cavity 18 through the hollow bristle members 30 is; provided. The handle portion 12, brush portion 20 and end portion 40 are preferably formed of a plastic material.

Figure 8:
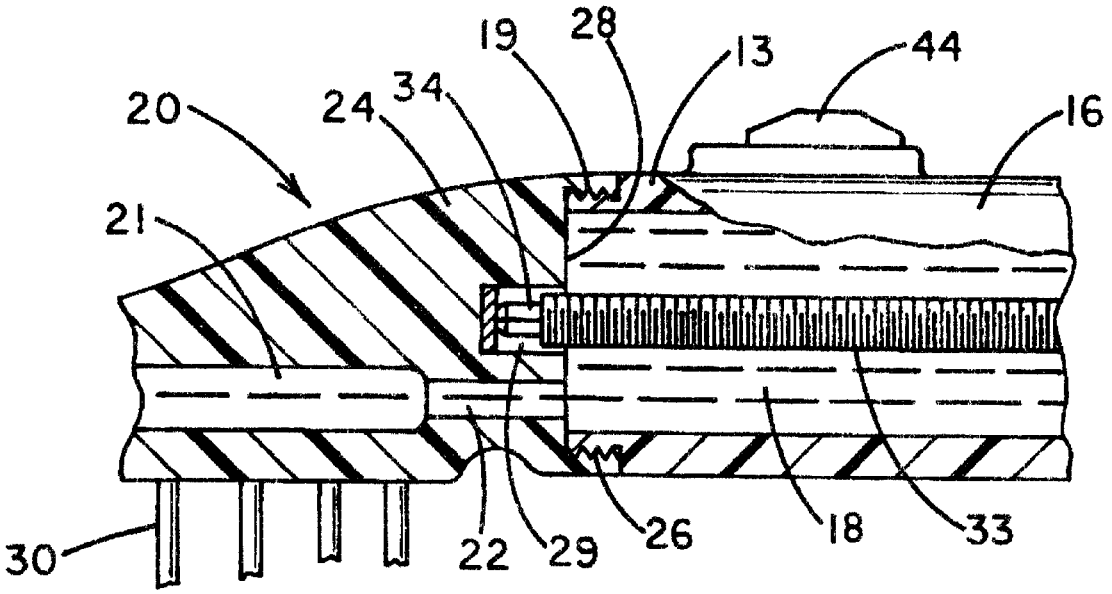
FIG. 8 is a cross sectional view taken along line 8—8 of FIG. 1.

With reference to FIG. 1 there is shown the gel dispensing hair brush 10 including a cylindrical handle portion 12 having an on/off switch 44 mounted by conventional means to an outside surface 16. Shown attached to the handle portion 12 are a brush portion 20 and an end portion 40. The brush portion is shown including an attachment member 24 and a brush member 25. The attachment member 24 is threadingly attachable to the handle portion open end 13 by means of a threaded portion 26 which is threadingly engageable to a threaded portion 19 of the handle portion 12 (FIG. 8). The end portion 40 is attachable to the handle portion closed end 14 by means of a pair of screws 47 which extend through the end portion 40 and are received in threaded apertures (not shown) formed in an end wall 15 (FIGS. 3 through 6).

Figure 4:
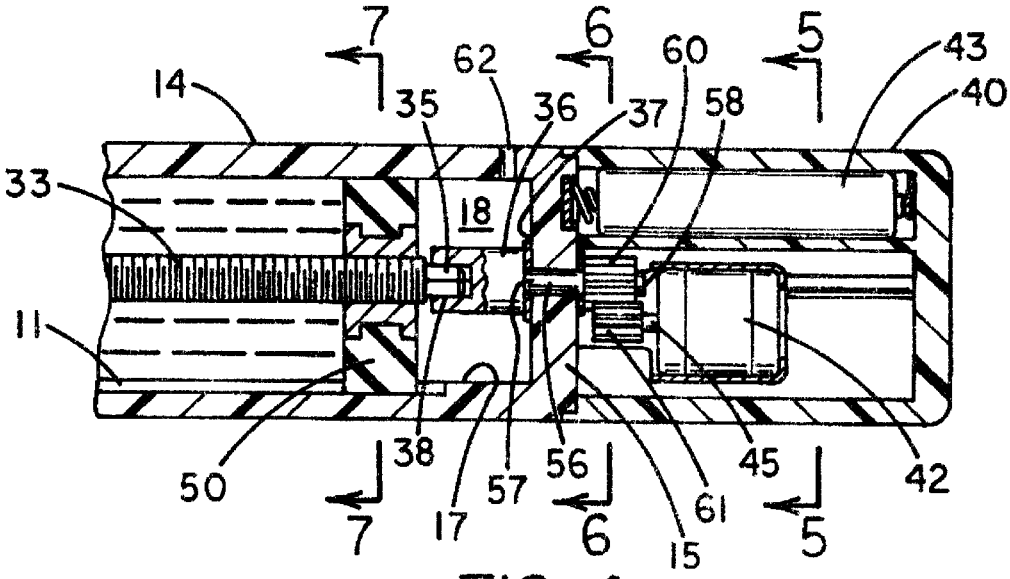
FIG. 4 is a cross sectional view taken along line 4—4 of FIG. 1.
Figure 5:
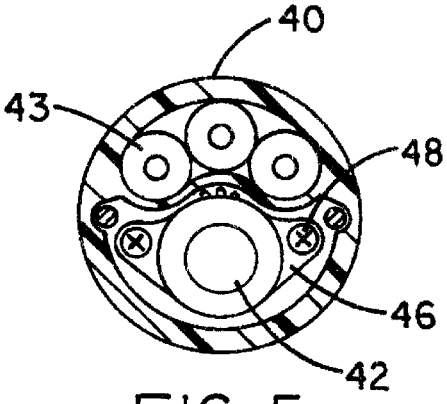
FIG. 5 is a cross sectional view taken along line 5—5 of FIG. 4.
Figure 6:
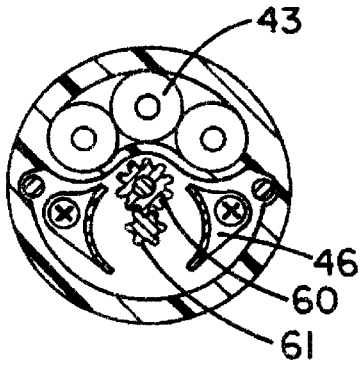
FIG. 6 is a cross sectional view taken along line 6—6 of FIG. 4.
Figure 9:
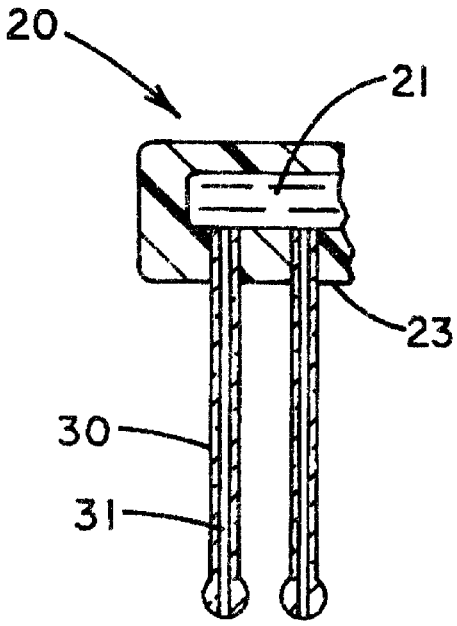
FIG. 9 is a cross sectional view taken along line 9—9 of FIG. 1.

With reference to FIGS. 4, 8, and 9 the handle portion 12 includes an elongated cavity 18 formed centrally therein. The central cavity 18 is in communication with a passageway 22 formed in the attachment member 24 and a reservoir 21 formed in the brush member 25. A plurality of spaced hollow bristle members 30 having a passageway 31 are shown in communication with the reservoir 21 through apertures 27 and disposed in a bottom wall 23 of the brush member 25. As will be described hereinbelow, a quantity of hair styling gel disposed in the elongated cavity 18 is forced through the passageway 22, into the reservoir 21 and through the hollow bristle members 30 for application to the hair of the user of the device.

With continued reference to FIGS. 4 and 8, a threaded rod 33 is shown axially disposed in the elongated cavity 18. The threaded rod includes a first end 34 and a second end 35. First and second ends 34 and 35 further include an end portion having identical square cross sectional profiles. The first end 34 is shown rotatably receivable in a recess 29 formed in a brush portion back wall 28. The second end 35 is shown rigidly receivable in a coupling 36 having a square recess 38, the coupling 36 shown disposed in the elongated cavity 18 proximate the end wall 15.

The coupling 36 includes a rear wall 37 to which is shown attached a shaft first end 57. A shaft 56 rotatably extends through the end wall 15 and a first gear 60 is fixedly attached to a shaft second end 58. The first gear 60 is shown meshedly engageable to a second gear 61 fixedly attached to a shaft 45 of a direct current motor 42. The direct current motor 42 is operably coupled to a plurality of batteries 43 through the on/off switch 44. The direct current motor 42 is shown mounted to the end wall 15 by means of flanges 46 secured by securing screws 48.

Figure 2:
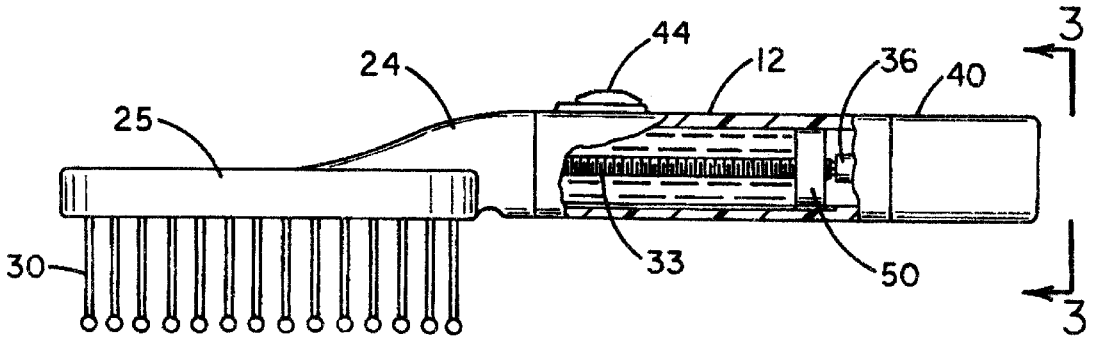
FIG. 2 is a partially sectioned side elevation view thereof.
Figure 3:
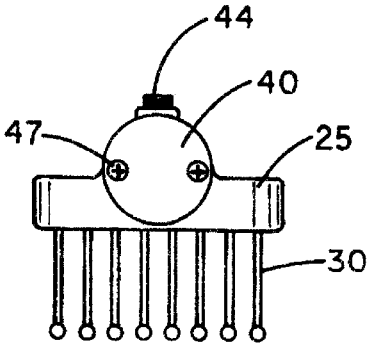
FIG. 3 is an end view of the present invention.
Figure 7:
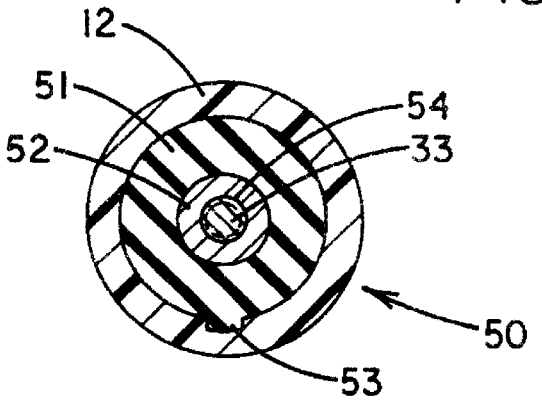
FIG. 7 is a cross sectional view taken along line 7—7 of FIG. 4.

To force the hair styling gel through the elongated cavity 18 and out the hollow bristle members 30, a cylindrical piston 50 threadingly attachable to the threaded rod 33 is shown in FIGS. 2 and 4. The piston 50 includes a peripheral portion 51 formed in surrounding relationship to a threaded metal insert 52 (FIG. 7). The peripheral portion 51 is preferably formed of rubber. The peripheral portion 51 is shown including a retaining projection 53 which is shown closely receivable in a longitudinal groove 11 formed along an inside surface 17 of the handle portion 12 (FIG. 4). The threaded metal insert 52 includes a central bore 54 formed in a center thereof, the central bore being sized and configured to threadingly receive the threaded rod 33.

In use, the piston 50 is threaded on the threaded rod 33 at one end thereof and the retaining projection 53 is inserted into the longitudinal groove 11 of the handle portion 12. The threaded rod 33 and piston 50 assembly is then inserted into the elongated cavity 18 and the square end portion is inserted into the square recess 38 of the coupling 36. Hair styling gel is then put into the elongated cavity 18 and the brush portion

20 is threaded to the handle portion 12 in such manner that the other end of the threaded rod 33 is received in the recess 29 formed in the back wall 28. By activating the direct current motor 42, the piston 50 advances along the threaded rod 33 from a position proximate the closed end 14 to a position proximate the open end 13. A vent 62 is shown in FIG. 4 disposed proximate the end wall 15 to enable the movement of the piston 50. As the piston 50 moves, it forces the hair styling gel out of the elongated cavity 18, into the passageway 22, into the reservoir 21, out the hollow bristle members 30 and onto the hair of the user.

When the piston 50 reaches the rear wall 28 of the attachment member 24, the brush portion 20 can be removed from the handle portion 12 and the threaded rod 33 and piston 50 assembly reinserted into the elongated cavity 18 as previously described. In this manner the gel dispensing hair brush 10 of the present invention is easily used and reused with a minimal amount of mess created by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gel dispensing hair brush comprising:

a handle portion having an open end, a closed end defined by an end wall, and an elongated cavity centrally formed therein;

a brush portion attachable to the handle portion open end and having a reservoir in communication with the elongated cavity, the brush portion further comprising a bottom wall, the bottom wall having a plurality of spaced hollow bristle members in communication with the reservoir;

an end portion attachable to the handle portion closed end;

a means for dispensing the gel from the elongated cavity through the hollow bristle members comprising a threaded rod axially disposed in the elongated cavity and having a first end and a second end, the threaded rod first end being rotatably receivable in a recess formed in a brush portion back wall and the threaded rod second end being receivable in a coupling disposed in the elongated cavity proximate the end wall, a piston sealingly receivable within the elongated cavity, the piston having a retaining projection formed along a peripheral portion thereof, the retaining projection being closely receivable in a longitudinal groove formed along an inside surface of the handle portion, the piston further having a central bore formed therethrough, the threaded rod being threadingly engageable to the central bore, and a shaft having a first end and a second end, the first end being fixedly attached to a coupling rear wall, the shaft rotatably extending through the end wall, and the shaft second end being drivingly engageable to an electric motor mounted in the end portion; and wherein the threaded rod first and second ends are interchangeably receivable in the recess formed in the brush portion back wall and the coupling.

2. The gel dispensing hair brush of claim 1, wherein the shaft second end is drivingly engageable to the electric motor by means of a first gear attached to the shaft second end and a second gear attached to a motor shaft, the first and second gears being meshedly engageable.

3. The gel dispensing hair brush of claim 1, wherein the handle portion further comprises a vent aperture formed proximate the end wall.

4. The gel dispensing hair brush of claim 1, wherein the electric motor is a direct current motor.

5. The gel dispensing hair brush of claim 1, wherein the threaded rod first and second ends further comprise an identically dimensioned square portion and wherein the threaded rod square portions are interchangeably closely receivable in a square recess formed in the coupling.

6. The gel dispensing hair brush of claim 1, wherein the handle portion is cylindrical and wherein the piston is cylindrical.

7. The gel dispensing hair brush of claim 1, wherein the piston further comprises a centrally disposed metal insert, the central bore being formed through the metal insert.

* * * * *